US005853155A

United States Patent [19]

Sullivan et al.

[11] Patent Number: 5,853,155

[45] Date of Patent: Dec. 29, 1998

[54] EXPANDABLE HOLDER FOR CARDBOARD AND A METHOD OF OPERATION THEREOF

[76] Inventors: Gerald R. Sullivan, 425 Clairbrook Crescent; Daniel R. Thompson, 418 Clairbrook Crescent, both of Waterloo, Canada, N2L 5V6

[21] Appl. No.: 851,511

[22] Filed: May 5, 1997

Related U.S. Application Data

[60] Provisional application No. 60/016,909 May 6, 1996.

[51] Int. Cl.[6] ..... A47G 23/02

[52] U.S. Cl. ..... 248/150; 248/166; 211/50; 211/201

[58] Field of Search ..... 248/150–152, 248/166, 167, 174, 175, 176.1, 434, 436, 447, 519, 525, 533, 530; 211/50, 201, 199, 195; 100/34

[56] References Cited

U.S. PATENT DOCUMENTS

| | | | |
|---|---|---|---|
| 374,906 | 12/1887 | Rovane | 47/47 |
| 897,367 | 9/1908 | Hendricks | 108/28 |
| 3,225,938 | 12/1965 | Bromssen | 211/85 |
| 3,559,339 | 2/1971 | Worley | 47/45 |
| 3,898,023 | 8/1975 | Faust | 425/110 |
| 5,033,628 | 7/1991 | Scholes | 211/50 |
| 5,042,371 | 8/1991 | Katz | 100/15 |
| 5,114,020 | 5/1992 | Martin | 211/50 |
| 5,123,665 | 6/1992 | Levy | 280/35 |
| 5,388,506 | 2/1995 | Vargas et al. | 100/34 |
| 5,577,440 | 11/1996 | Marie | 100/34 |
| 5,582,098 | 12/1996 | Clinton | 100/34 |
| 5,593,046 | 1/1997 | Katsuura et al. | 211/41 |

*Primary Examiner*—Leslie A. Braun
*Assistant Examiner*—Tan Le
*Attorney, Agent, or Firm*—Daryl W. Schnurr

[57] ABSTRACT

An expandable holder for storing cardboard, newspapers or similar itmes has a front support and a rear support connected to one another by arms. The arms are pivotally connected to the supports along each side. The rear support is mounted on a vertical wall. The supports are formed from elongated members. When cardboard and the like is inserted into the holder, the supports are moved further apart. As more cardboard is inserted the supports move still further apart until the holder is in a fully open position. In each position between a closed position and an open position the cardboard is clamped between the supports either by gravity or by manually moving the holder toward the closed position after inserting the cardboard.

16 Claims, 3 Drawing Sheets

EXPANDABLE HOLDER FOR CARDBOARD AND A METHOD OF OPERATION THEREOF

BACKGROUND OF THE INVENTION

1. Field of the Invention

This invention relates to a holder for cardboard, newspapers and the like and in particular to a holder that can expand from a minimum position to a fully open position as additional cardboard is inserted into the holder.

2. Description of the Prior Art

As recycling programs are used with increasing frequency, residents are required to segregate garbage into various categories before pick-up. Cardboard is one of the materials that is required to be segregated in many recycling programs. Usually the cardboard is required to be cut within a particular size range, to be either flattened or to be cut into individual sheets and to be bundled (a number of sheets bound together by string, twine or the like). As is well known, cardboard boxes occupy a relatively large volume compared to their weight before they are cut up or collapsed. The boxes clutter the area in which they are stored (often a garage) until garbage pick-up day arrives. Since one box is often discarded at a time throughout the week prior to garbage pick-up, a resident usually does not cut, collapse or bundle the cardboard until the pick-up time arrives as, initially, there might only be one box and there is not sufficient cardboard to make up an entire bundle. Also, a resident may not wish to bundle the cardboard until all of the cardboard that might become available prior to pick-up is present. In addition to having a number of boxes strewn about prior to garbage pick-up day, a resident may find that when the pick-up day arrives, there is not sufficient time to cut, collapse and bundle all of the cardboard. If the bundling is not done properly, the pick-up personnel may refuse to take the bundle. Also, if the resident is particularly hard-pressed for time, the resident may decide to delay bundling the cardboard until the following week while the volume of cardboard in the storage area further increases and the time required to cut, collapse and bundle the cardboard increases as well.

SUMMARY OF THE INVENTION

It is an object of the present invention to provide a cardboard holder that permits a resident to cut or collapse cardboard as each box is discarded and to store that cardboard in an orderly fashion that does not take up floor space, while adding to the stored cardboard periodically and ultimately bundling the cardboard while in the holder.

An expandable holder for supporting objects such as cardboard, newspapers and the like has a front support and a rear support. The supports each have two sides and are interconnected by arms extending between said supports. The arms are pivotally connected to said supports and there is an upper arm and a lower arm on each side of said supports. The supports extend upward substantially beyond said arms when said holder is in an upright position. The holder has a closed position in which said supports are in contact with one another and an open position in which said supports are separated from one another with at least one object being located between said supports. The at least one object rests on said upper arms to a fully open position to receive additional objects between said supports.

A method of storing objects such as cardboard, newspapers and the like uses a holder having a front support and a rear support pivotally connected to one another by arms extending between said supports. The method comprises inserting said objects between said supports to force said supports apart from one another, the weight of said objects forcing said front support downward and clamping material between said supports. A further method of storing objects such as cardboard, newspapers and the like uses a holder having a front support and a rear support pivotally connected to one another by arms extending between said supports. The method comprises manually opening said holder by raising said front support relative to said rear support, inserting objects to be stored between the supports and manually moving said front support downward relative to said rear support to clamp said objects between said supports. In a further embodiment, the holder can be constructed so that pivotal movement of the arms relative to the supports has sufficient friction to enable the holder to be manually adjusted before and after inserting objects into the holder.

DESCRIPTION OF A PREFERRED EMBODIMENT

Figure 1:
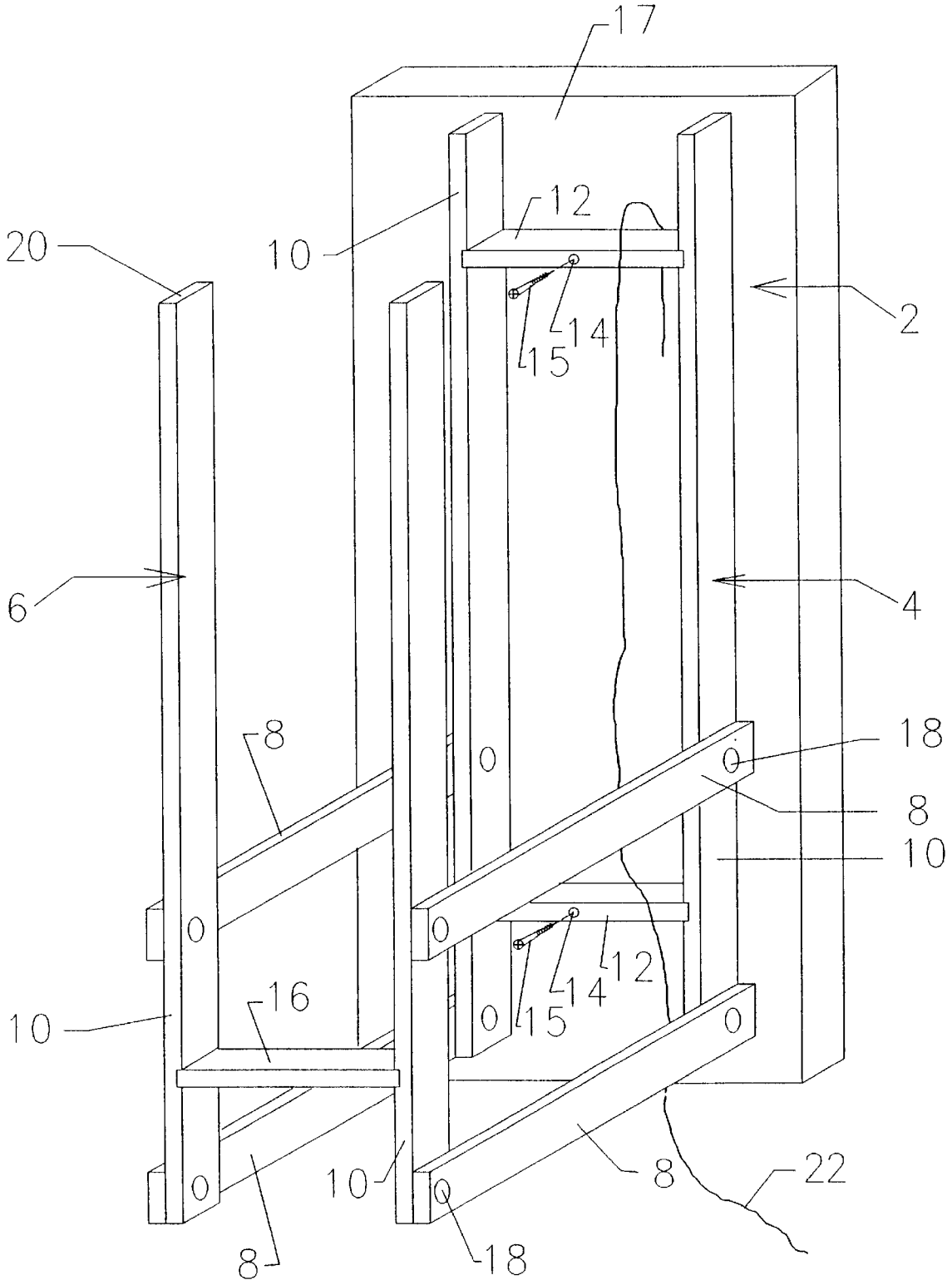
FIG. 1 is a perspective view of a holder in a maximum position.
Figure 2:
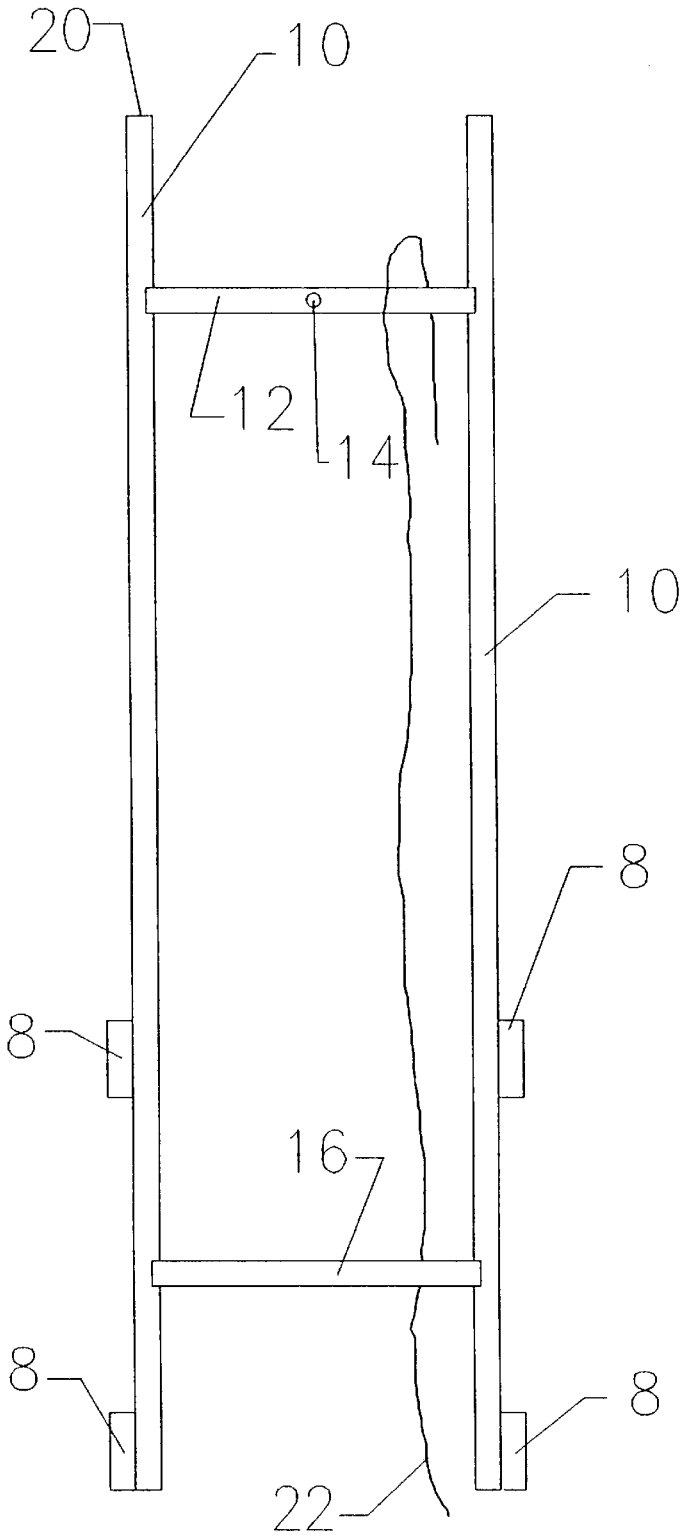
FIG. 2 is a front view of the holder in a maximum position.

Referring to FIGS. 1 and 2, a holder 2 has a rear support 4, a front support 6 connected to one another by pivotal arms 8. Preferably, the rear support 4 has two vertical elongated members 10 and two horizontal cross members 12. The cross members 12 have openings 14 for receiving screws (15) for attaching the holder 2 to a vertical wall (17).

Preferably, the front support 6 also has two vertical elongated members 10 with one horizontal cross member 16. The cross member 16 is shown in FIG. 1 to be slightly narrower than the cross members 12. Preferably, there are two pivotal arms 8 on each side of the device extending between one vertical elongated member on the rear support and one vertical elongated member on the front support. While various materials will be suitable for the device (for example plastic, steel), wood is the preferred material as the arms 8 can then be connected to the elongated members 10 by screws (not shown) in openings 18. The screws can easily be tightened to a sufficient degree to allow the arms to pivot about the vertical elongated members and yet be sufficiently tight so that the front support will maintain a particular position vis-a-vis the rear support when the holder is moved to that position.

Figure 3:
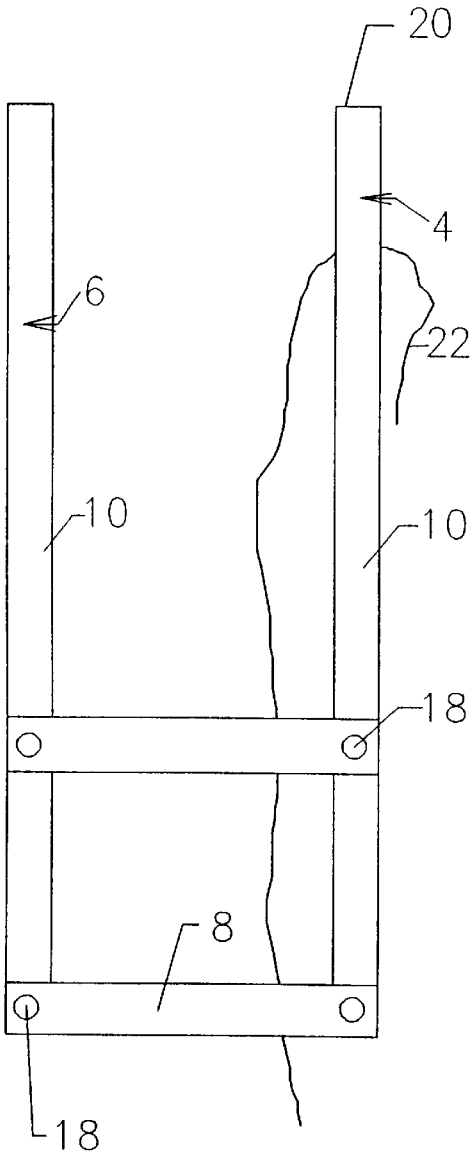
FIG. 3 is a side view of the holder in the maximum position.
Figure 4:
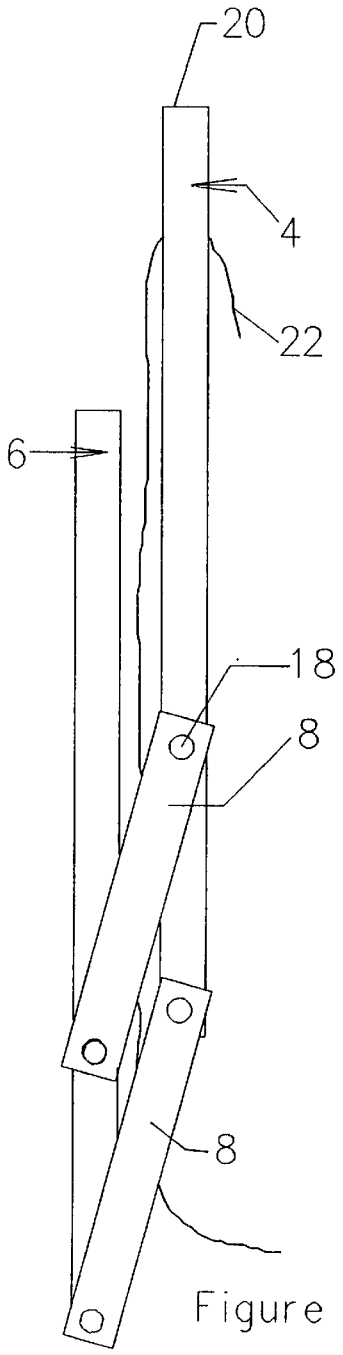
FIG. 4 is a side view of the holder in a minimum position.

Referring to FIGS. 3 and 4, in FIG. 3, the holder 2 is shown in a fully open position (i.e. maximum) and in FIG. 4, the holder is shown in a fully closed position (i.e. minimum). In the fully open position, the pivotal arms 8 are at right angles to the supports 4, 6 and the perpendicular distance between the rear support 4 and the front support 6 is the maximum distance. In the closed position shown in FIG. 4, the rear support 4 and front support 6 are in contact with one another. The holder has numerous open positions between the fully opened position and the closed position and is designed to expand to accomodate additional objects and to move toward the closed position to clamp the objects between the supports. The holder can be adjusted manually or by gravity simply by tightening or loosening screws that form pivot points for the arms on the supports.

When the holder 2 is used, the holder will be in the closed position shown in FIG. 4. The holder will be manually opened slightly and several flat or flattened sheets of cardboard are inserted between the rear support 4 and the front support 6. The cardboard is held generally parallel to the rear and front supports. The holder will accommodate sheets of cardboard that extend well beyond a top 20 of the rear support 4 and well beyond the sides of the holder. If the space between the rear and front supports is too large after the sheets of cardboard have been inserted, the front support can be manually pushed towards the rear support until the front support contacts the sheets of cardboard to hold them tightly against the rear support. As further cardboard boxes are discarded, the procedure is repeated with the holder being further opened to accommodate additional flat or flattened sheets of cardboard until it is desired to remove the cardboard from the holder or until the holder has been opened to the fully open position and the cardboard within the holder is held so tightly that no additional cardboard can be inserted. After the first few sheets of cardboard are inserted, additional sheets can usually be inserted without manually further opening the holder. As additional sheets are inserted, the holder will open further to accommodate those sheets simply by the insertion of the cardboard forcing the front and rear supports further apart from one another.

When the holder of the present invention is manufactured, the holder can have sufficient friction or stiffness that it will remain in an open position when moved manually to that position. Alternatively, the holder can be manufactured so that the arms pivot easily relative to the supports. With this type of holder, the holder can be moved manually to an open position. As soon as the holder is released it will return by gravity toward the closed position, thereby clamping the cardboard between the supports. With this embodiment, often the cardboard is inserted, the weight of the cardboard will force the holder toward the closed position or, the device can be manually moved toward the closed position, to clamp the cardboard between these supports.

In most cases, a user of the holder will want to bundle the sheets by tying them together with a suitable string by extending the string vertically and horizontally around a central portion of the cardboard held within the holder and tying the string before removing the cardboard from the holder. It is preferable that a length of string be placed in the holder extending vertically between the front and rear support, but near the rear support, prior to any cardboard being inserted. Then, when the first cardboard is inserted, that string will lie to the rear of the first sheet. The string is either long enough or connected to a supply of string so that the cardboard within the holder can be bundled from this first string. In FIGS. 1 to 4, a filament or string 22 is shown as being supported by the holder 2.

Obviously, if no string is inserted into the holder before the cardboard that is desired to be bundled, the string can still be threaded into the holder behind the cardboard to enable the cardboard to be bundled. The cross member 16 on the front support 6 is located some distance beneath the two upper pivotal arms 8. The lowermost edge of the cardboard in the holder will rest on these two upper arms. Thus, the string extending beneath this lower edge along the rear of the cardboard is readily accessible to a user simply by reaching between the two vertical elongated members 10 of the front support 6 beneath the upper pivotal arms 8 and above the cross member 16.

After the cardboard within the holder in bundled, it can be removed and the holder returned manually to the closed position. Since the holder can be mounted on any vertical wall, it can be mounted high enough so that it is generally out of the way yet low enough so that it is readily accessible to a user.

Obviously, any filament that is strong enough will be suitable for tying the cardboard. For example, rope, wire, cord and twine can be used. Items other than cardboard or newspapers can be stored using the holder. The holder can be made in various sizes. One size that is suggested as being suitable is a width of 8.5", a height of 21" and a depth of 10".

Numerous variations could be made to the holder. For example, the front and rear supports could be made of a single sheet of material rather than from elongated members. While this would not permit the same accessibility, the device would still be usable and openings could be located in the sheets of material to allow accessibility at the desirable locations. The holder could also be constructed so that it will always fall from its own weight to the closed position. While this has an advantage in that it does not have to be moved manually to that position, it also has a disadvantage in that the holder will have to be held open with one hand while inserting cardboard sheets with the other hand.

We claim:

1. An expandable holder and vertical wall for supporting objects such as cardboard, newspapers and the like on said vertical wall, said holder comprising a front support and a rear support, said rear support being affixed to said vertical wall, said supports each having two sides, said supports being interconnected by arms extending between said supports, said arms being pivotally connected to said supports, there being an upper arm and a lower arm on each side of said supports, said supports extending upward substantially beyond said arms when said holder is in an upright position, said holder having a closed position in which said supports are in contact with one another and an open position in which said supports are separated from one another with at least one object adapted to be located between said supports, said at least one object adapted to rest on said upper arms, said holder being continuously expandable to a fully open position as additional objects are placed between said supports.

2. A holder as claimed in claim 1 wherein said supports are formed from elongated members.

3. A holder as claimed in claim 2 wherein, when said holder is in an upright position, each support having two vertical elongated members said front support having a cross member, said rear support having two cross members.

4. A holder as claimed in claim 2 wherein the supports are made from wood and said elongated members and arms are connected to one another by screws.

5. A holder as claimed in claim 2 wherein the arms are parallel to one another.

6. A holder as claimed in claim 2 wherein the holder is in a fully opened position when said arms are at right angles to said supports.

7. A holder as claimed in claim 2 wherein said front support and rear support are parallel to one another.

8. A holder as claimed in claim 2 wherein the arms pivot easily relative to the supports so that said holder will move towards the closed position by gravity.

9. A holder as claimed in claim 2 wherein pivotal movement of the arms relative to the supports has sufficient friction so that the holder can be manually adjusted to an open position and will remain in that position until manually moved to another position.

10. A holder as claimed in claim 2 wherein the objects are sheets of material and, after the first sheets are inserted, additional sheets can be inserted between the supports by using the sheets themselves to force the supports further apart from one another.

11. A holder as claimed in claim 2 wherein there is a filament on the holder to bundle the objects supported by the holder.

12. A holder as claimed in claim 2 wherein said holder is made of plastic or steel.

13. A method of storing objects such as cardboard, newspapers and the like on a vertical wall using a holder having a front support and a rear support pivotally connected to one another by arms extending between said supports, said rear support being affixed to said vertical wall, said method comprising manually opening said holder by raising said front support relative to said rear support, inserting objects to be stored between the supports and moving said front support downward relative to said rear support to clamp said objects between said supports.

14. A method as claimed in claim 13 wherein the holder has a length of filament supported thereon, said filament extending downward near said rear support, said method comprising the steps of tying said filament around said objects while said objects are supported in said holder.

15. A method of storing objects such as cardboard, newspapers and the like on a vertical wall using a holder having a front support and a rear support pivotally connected to one another by arms extending between said supports, said rear support being affixed to said vertical wall, said method comprising inserting said objects between said supports to force said supports apart from one another, the weight of said objects forcing said front support downward and clamping said material between said supports.

16. A method as claimed in claim 15 wherein the holder has a length of string supported thereon, said filament extending downward near said rear support, said method comprising the steps of tying said string around said objects while said objects are supported in said holder.

* * * * *